US008672818B2

(12) United States Patent
Welch

(10) Patent No.: US 8,672,818 B2
(45) Date of Patent: Mar. 18, 2014

(54) METHOD AND APPARATUS FOR IMPROVING POSTURE

(76) Inventor: Elizabeth A. Welch, St. Charles, IL (US)

( * ) Notice: Subject to any disclaimer, the term of this patent is extended or adjusted under 35 U.S.C. 154(b) by 98 days.

(21) Appl. No.: 12/799,346

(22) Filed: Apr. 22, 2010

(65) Prior Publication Data

US 2011/0263391 A1 Oct. 27, 2011

(51) Int. Cl.
*A63B 21/00* (2006.01)

(52) U.S. Cl.
USPC ..... 482/132

(58) Field of Classification Search
USPC ..... 482/131, 132, 139; 601/63, 120, 121
See application file for complete search history.

(56) References Cited

U.S. PATENT DOCUMENTS

| | | | | | |
|---|---|---|---|---|---|
| 2,986,314 | A | | 5/1961 | Miller | |
| 3,419,268 | A | * | 12/1968 | Bellet | 482/132 |
| 3,719,185 | A | * | 3/1973 | Hanes | 606/240 |
| 3,820,781 | A | | 6/1974 | Kane | |
| 3,842,453 | A | * | 10/1974 | Redfield | 5/643 |
| 3,847,144 | A | * | 11/1974 | Wright | 601/120 |
| 4,325,363 | A | | 4/1982 | Berkeley | |
| 4,501,034 | A | | 2/1985 | Greenawalt | |
| 4,759,543 | A | * | 7/1988 | Feldman | 482/148 |
| 4,770,414 | A | * | 9/1988 | Fredrickson et al. | 482/148 |
| 4,863,158 | A | | 9/1989 | Tassone | |
| 4,945,900 | A | * | 8/1990 | Masuda | 601/120 |
| 5,108,150 | A | | 4/1992 | Stas et al. | |
| 5,147,287 | A | | 9/1992 | Jewell et al. | |
| 5,328,431 | A | | 7/1994 | Winslow | |
| 5,367,731 | A | | 11/1994 | O'Sullivan | |
| 5,467,490 | A | | 11/1995 | Rice | |
| D369,491 | S | | 5/1996 | Bonaddio et al. | |
| D370,819 | S | | 6/1996 | Bonaddio et al. | |
| 5,577,995 | A | * | 11/1996 | Walker et al. | 601/120 |
| 5,709,649 | A | | 1/1998 | Chitwood | |
| 5,752,903 | A | | 5/1998 | Chang | |
| 5,824,013 | A | * | 10/1998 | Allen | 606/240 |
| 5,891,003 | A | * | 4/1999 | Deac et al. | 482/106 |
| 5,937,460 | A | | 8/1999 | Humphries | |
| 6,024,762 | A | | 2/2000 | Gray | |
| 6,030,034 | A | | 2/2000 | Plohetski | |
| 6,129,650 | A | | 10/2000 | Wedge, Jr. | |
| D445,506 | S | | 7/2001 | Vinson et al. | |
| 6,484,335 | B2 | | 11/2002 | Gilbert | |

(Continued)

OTHER PUBLICATIONS

"Densities" http://www.iem-inc.com/tooldens.html.*

(Continued)

*Primary Examiner* — Oren Ginsberg
(74) *Attorney, Agent, or Firm* — Carla Gannon Law

(57) ABSTRACT

An apparatus for improving posture comprises a bar element and a pad element centered along the length of the bar element. The bar element is constructed from a weighty material so as to provide a significant and constant downwardly directed weight. The pad element is constructed from a relatively lightweight material as compared to the bar material, but has a very specific cervical curve-accommodating, outer pad diameter or outer pad radius of curvature. The outer pad diameter or outer pad radius of curvature substantially matches that of a normal cervical curve. Together, the radius of curvature of the pad element and the weight of the bar element provide the user with a weighted template against which the user may align the cervical portion of his or her spine and commence resistance muscle training against the downwardly directed weight for improving core muscle groups for improving and/or maintaining one's posture.

2 Claims, 8 Drawing Sheets

(56) References Cited

U.S. PATENT DOCUMENTS

| | | | | |
|---|---|---|---|---|
| 6,500,136 | B2 | 12/2002 | Meyer | |
| 6,652,431 | B1 | 11/2003 | Mattox | |
| 6,748,615 | B1 | 6/2004 | Tiedemann | |
| 6,752,747 | B2 * | 6/2004 | Yu | 482/110 |
| 6,951,038 | B1 | 10/2005 | Ganoe, Sr. | |
| 7,104,939 | B1 * | 9/2006 | Martinez | 482/142 |
| 2002/0072455 | A1 * | 6/2002 | Akins | 482/93 |
| 2002/0193714 | A1 * | 12/2002 | Pecora | 601/121 |
| 2004/0033867 | A1 | 2/2004 | Katami | |
| 2006/0116256 | A1 | 6/2006 | Carney | |
| 2006/0135323 | A1 * | 6/2006 | Sjobakk et al. | 482/92 |
| 2006/0211551 | A1 | 9/2006 | Mandell | |
| 2007/0032355 | A1 | 2/2007 | DiGiacomo | |
| 2008/0167168 | A1 * | 7/2008 | Hurst | 482/132 |

OTHER PUBLICATIONS

"Density Converter" http://www.unitconversion.org/unit_converter/density.html.*

* cited by examiner

METHOD AND APPARATUS FOR IMPROVING POSTURE

BACKGROUND OF THE INVENTION

1. Field of the Invention

The present invention generally relates to a method and apparatus for exercising various core muscle groups. More particularly, the present invention relates to a method and apparatus for exercising core muscle groups for supporting, improving, and maintaining proper posture.

2. Description of Prior Art

The prior art is replete with examples of various exercise devices and the like for targeting specific muscle groups. Those muscle groups central to maintaining correct posture involve core type muscle groups. A number of bar-like exercises devices designed to rest on or about the shoulders for training core muscle groups are among the more relevant art pertaining to this specification, some of which are briefly described hereinafter.

U.S. Pat. No. 3,820,781 ('781 patent), which issued to Kane, discloses a Body Waist Exerciser. The '781 patent describes an exerciser for use by golfers for training body muscles to twist and bend as muscles normally do in a conventional golf swing, or for the general public in body-building, there is provided an elongated exerciser shaft of about 40 inches in length and 1 or 2 inches in cross-sectional diameter, the shaft having a mid-section of yoke shape-defined arc of 180 degrees of a size about snugly fittable around the neck of a person at shoulder height, with the yoke mid-section arcing from alignment between proximal ends of about diametrically oppositely extending elongated shafts, the arced mid-section being such that the oppositely extending shafts are positioned substantially forwardly of the body of the shoulders respectively when the yoke mid-section is mounted around the back of a person's neck, thereby avoid unnatural tensions on the shoulders during a draping of respective forearms forwardly over the respective shafts distal portions thereby making possible a natural upright posture while moving the upper torso to and fro while maintaining from the waist downwardly substantially stationary in order to reduce flabbiness around the waist, the cross-section of the respective elongated shafts being substantially rounded and the shafts each gradually tapering in distally outward directions.

U.S. Pat. No. 4,770,414 ('414 patent), which issued to Fredrickson et al, discloses a Body Exercising Device. The '414 patent describes a rigid exercising bar device for performing twisting and bending exercises about the waist is provided, comprising an elongated curved middle portion and two curved end portions, the middle portion being bowed or contoured for a comfortable and effective fit around the neck and on the shoulders, the end portions being curved along a different plane and outwardly and downwardly relative to the middle portion, and serving as hand grips for the user such that the arms are comfortably extended during use.

U.S. Pat. No. 4,863,158 ('158 patent), which issued to Tassone, discloses a Sit Up Exercise Aid. The '158 patent describes a sit up exercise bar employed to add resistance for sit up exercises, and positions the subject's hands and arms so as to produce a fluent motion, reducing stresses on the lower back. The sit up bar has yoke form of a pair of aligned straight sections and a central neck bow which curves behind the subject's neck. A pair of handles extends forward from the respective straight sections. These position the subject's hands in front of the shoulders or particularly, a few inches in front of the anterior deltoid.

U.S. Pat. No. 5,108,150 ('150 patent), which issued to Stas et al., discloses a Head Rest and Neck Support Assembly. The '150 patent describes an improved head rest and neck support assembly for seating furniture. The assembly contains an elongated support bar which is mounted horizontally to the seating furniture behind the neck of a prospective user. One end of the support bar has a pivoting carrying element with a cushion attached thereto. The cushion may swivel between a neck support position and a side head rest position. In a second embodiment, the elongated support bar in the assembly has a groove running the length of the bar. The cushion is also elongated and possesses a track or partial track which cooperates with the groove in the elongated support bar to allow the elongated cushion to slide horizontally along the bar. A portion of the track is capable of exiting the groove and allowing the elongated cushion to bend into an L-shape.

U.S. Pat. No. 5,752,903 ('903 patent), which issued to Chang, discloses an Exercise Bar Assembly. The '903 patent describes an exercise bar assembly for use as a push up device, sit up device and a hanging bar includes a shaft with first and second ends, first and second C-shaped handles disposed on the shaft, an inner pipe enclosing a middle portion of the shaft, an outer pipe enclosing the inner pipe and a hollow outer sleeve enclosing the outer pipe.

U.S. Pat. No. 6,652,431 ('431 patent), which issued to Mattox, discloses a Squat Exercise Hook Harness. The '431 patent describes a squat exercising hook harness comprising a pair of generally parallel aligned bars interconnected and spaced by a joining member to accommodate the neck of a person therebetween. The aligned bars each include bends therein that define a base section and a chest section. The chest sections are spaced by the base sections from the joining member. The base sections define a base plane and the chest sections form an obtuse angle in combination with the base sections. Each free end of the chest sections has an upturned portion at the end. A T-member has a leg and a cross bar connected to a first end of the leg. A second end of the leg is connected to a midpoint of the joining member so that the T-member extends from the joining member in an inverted fashion and defines an angle between the range of 60 degrees to 120 degrees with the base plane.

United States Patent Application Publication No. 2006/0211551, which was authored by Mandell, discloses and describes an Exercise Device and certain associated methodology. The device's aim is to improve a user's posture. Even though the exercise device is portable, it provides an active workout of those muscles involved in maintaining correct posture. In accordance with an important aspect of the invention, the exercise device in accordance with the present invention includes a spacer. One end of the spacer is placed against the user's body and the other end forms a fixed pivot point for the device. In one embodiment of the invention, the exercise device includes a pair of spaced apart handle bars coupled to a flexible member and a spacer for spacing the device away from the user's body. The spacer may either be a separate device or integrally formed with the other members. With the handle bars spaced away from the user's body, the spacer allows the user to repetitively bend and straighten the flexible member to strengthen those muscles associated with proper posture. Alternate embodiments of the exercise bar include an adjustable tension mechanism and an adjustment mechanism for adjusting the distance between the handlebars. Also disclosed is various exercise methods for use with a flexible or deformable bar in which the user's body forms a fixed pivot point.

United States Patent Application Publication No. 2007/0032355, which was authored by DiGiacomo, discloses and describes and Exercise Device either in assembled or kit form, particularly for emulating and improving a golf swing. The apparatus includes an elongate bar having hand grips each disposed at opposite ends thereon, and a neck support disposed at a substantially central portion of the bar. The bar includes at least one forearm plate permanently or removably attached on an underside near either end of the bar. At least one resistance band is provided, although a plurality is preferably provided in the kit form, for removable attachment of the forearm plate with a foot brace. Such removable attachment advantageously facilitates changing of resistance bands to different levels of resistance/length, switching of the foot brace, as well as, e.g., in an embodiment including two forearm plates, switching between attachment of the resistance band to either forearm plate. Accordingly, a user may work both the right or left side muscle groups.

It may be seen from a review of the prior art that the prior art fails to disclose a method and apparatus for improving posture as described in more detail hereinafter.

SUMMARY OF THE INVENTION

The present invention essentially provides an exercise device for exercising core muscle groups with an eye toward improving overall posture, particularly cervical curve posture. The core exercising device according to the present invention preferably comprises a bar element; bar sheathing; opposed end caps; a pad element; and a pad sheathing or cover. The bar element is preferably cylindrical in geometry and constructed from a weighty bar material such as steel and has opposed bar ends, a preferable bar length intermediate the bar ends, and a select bar diameter as chosen or selected from a number of diameters depending on the user's physique and capability.

It is contemplated that a variety of weights may be made available depending on the user's physique and capabilities. It is thus contemplated that a first bar element may comprise a weight on the order of 288 ounces; a second bar element may comprise a weight on the order of 256 ounces; a third bar element may comprise a weight on the order of 224 ounces; a fourth bar element may comprise a weight on the order of 192 ounces; and a fifth bar element may comprise a weight on the order of 160 ounces.

The pad element is preferably cylindrical in form and constructed from a high memory foam material relatively lightweight (or negligible in weight) as compared to the bar element. The pad element has opposed pad ends and a preferred pad length of about one-third the length of the bar length. The pad element further comprises a cervical curve-accommodating or receiving outer pad diameter preferably on the order of 3.6 inches thereby effecting a radius of curvature on the order of 1.8 inches. The pad element further comprises a bar-receiving, inner pad diameter for receiving the bar element.

The bar element is preferably received in the pad element such that the two cylindrical elements are coaxial. Further, the bar element is received in the pad element such that the pad element is centered along the bar length equidistant from the bar ends. The outer pad diameter is specifically sized so as to accommodate or be finely received in a user's cervical curve for providing tactile information to the user as to how or to what degree the user's cervical curve should be adjusted so as to approximate the radius of curvature of the outer pad diameter.

Together the muscular activity associated with resistance training as operating against the downwardly directed weight of the bar element and the fixed outer pad diameter or outer pad radius of curvature (that substantially matches that of a standard cervical curve) operate to strengthen the core muscles associated with improving and/or maintaining correct posture, particularly correct cervical curve posture.

BRIEF DESCRIPTION OF THE DRAWINGS

Other features of my invention will become more evident from a consideration of the following brief description of patent drawings:

FIG. 3(*b*) is a fragmentary side view type depiction of a user's cervical curve with a weighted core exercising device according to the present invention being received in the user's cervical curve.

DESCRIPTION OF THE PREFERRED EMBODIMENTS

Figures 1, 2:
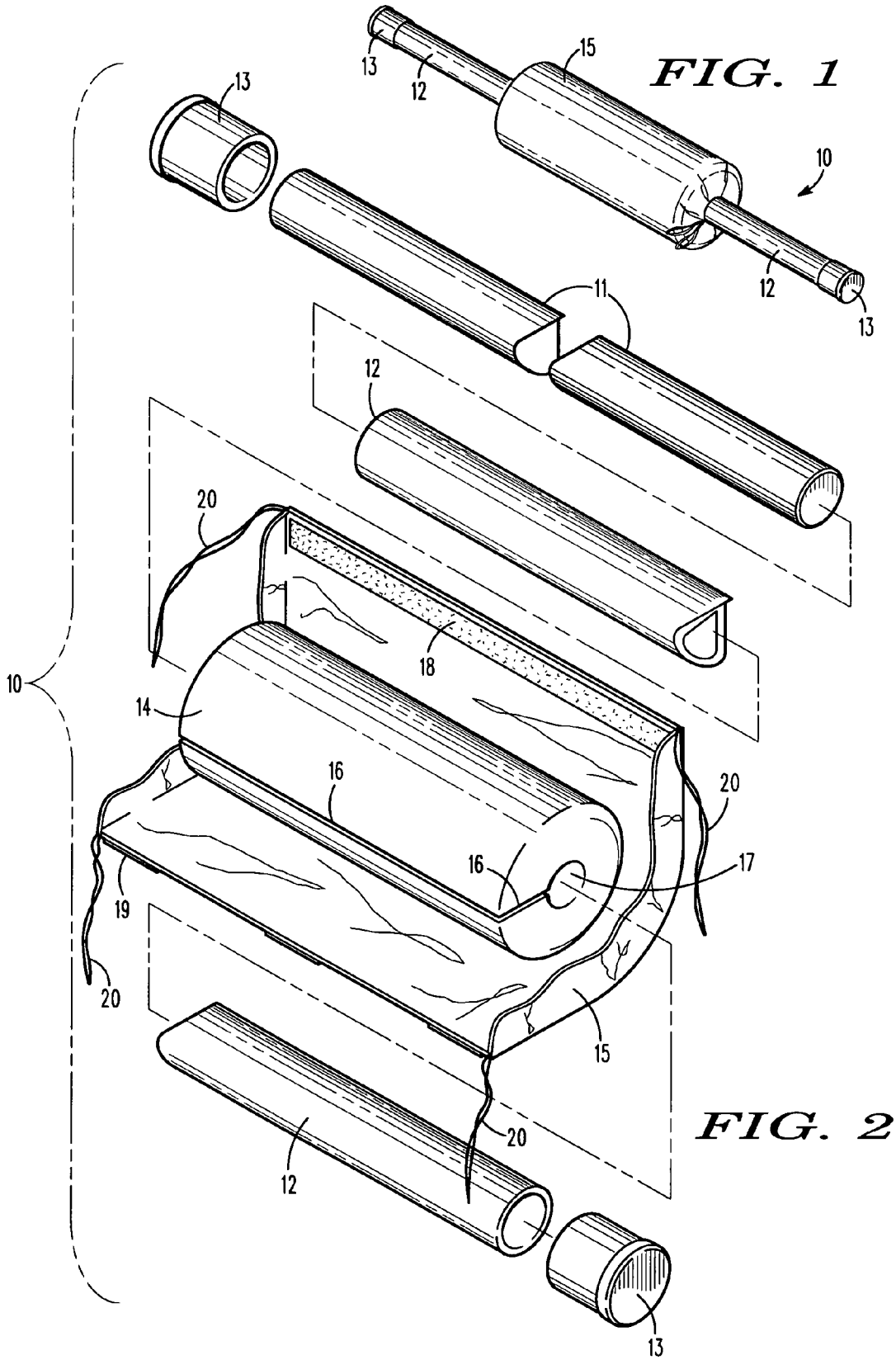
FIG. 1 is a top perspective view of a fully assembled core exercising device according to the present invention.
FIG. 2 is a fragmentary exploded perspective view of the core exercising device otherwise depicted in FIG. 1 with certain parts broken away for illustrative purposes.
Figure 3A:
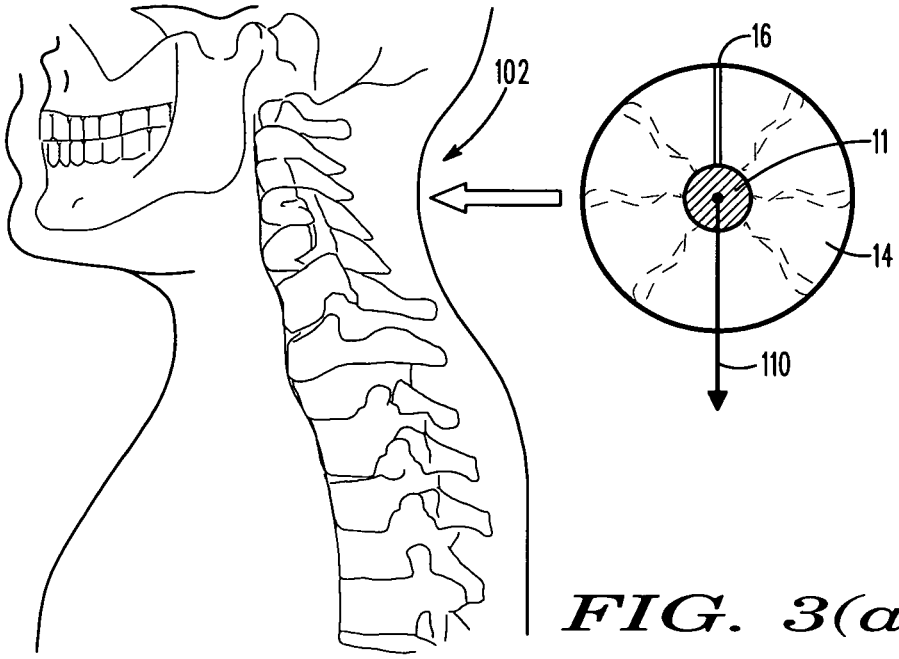
FIG. 3(*a*) is a fragmentary side view type depiction of a user's cervical curve with a weighted core exercising device according to the present invention being received in the user's cervical curve.
Figure 3B:
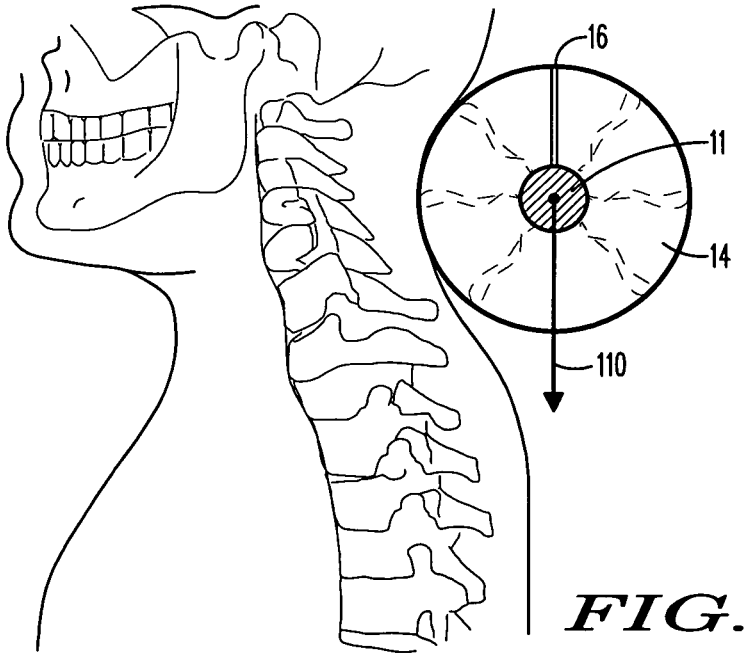
Figure 9:
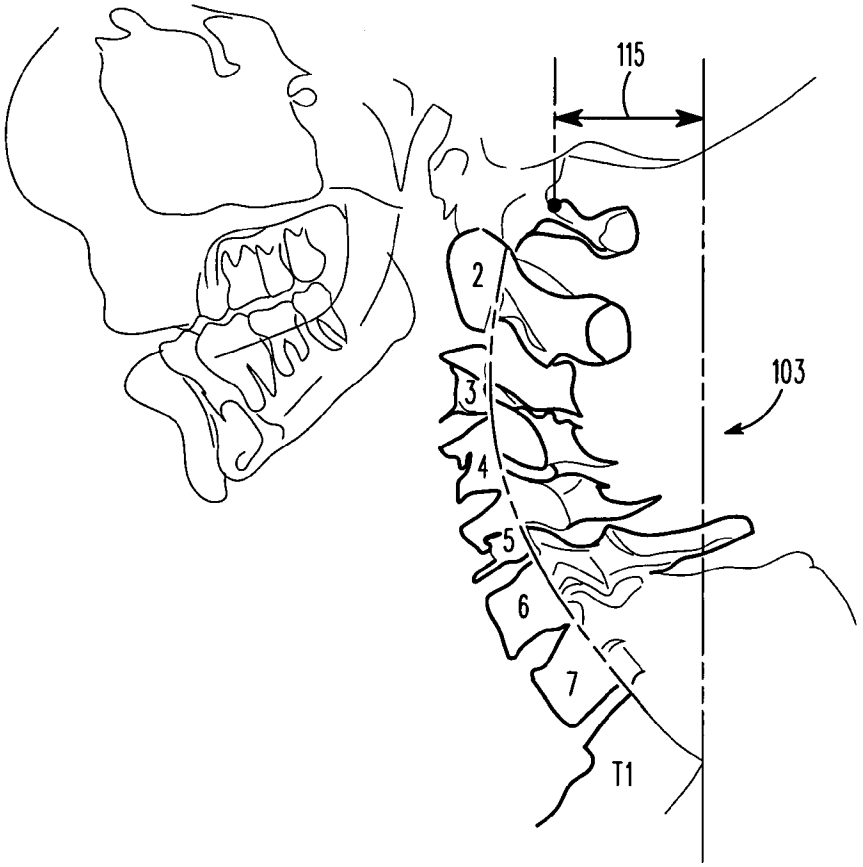
FIG. 9 is a fragmentary side view type depiction of cervical curve anatomy showing an abnormal, forward lean of the cervical curve.
Figure 11:
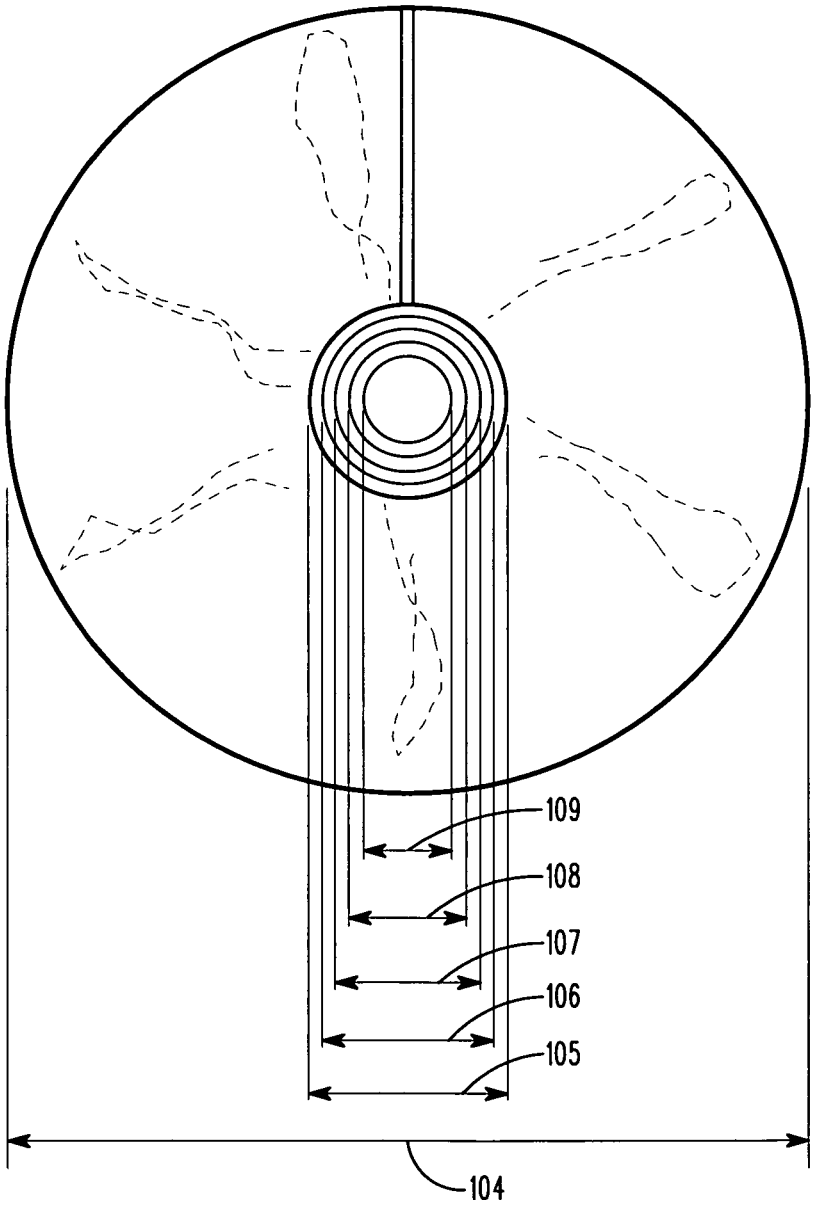
FIG. 11 is an end view depiction of a pad element of the core exercising device according to the present invention showing relative diameters of the pad element as compared to five select diameters of five weighted bar elements of the core exercising device.

Referring now to the drawings with more specificity, the preferred embodiment of the present invention essentially provides an exercise device 10 for exercising core muscle groups with an eye toward improving overall posture, particularly cervical curve posture. Proper cervical curve posture as at 102 is generally depicted in FIG. 3(*a*), 3(*b*) and 10. It will be noted from an inspection of the noted figures that a standard or proper cervical curve 102 comprises a standard or typical radius of curvature with minimal or negligible forward lean (as at 116). FIG. 9, by comparison, depicts improper forward lean (as at 115) at the cervical curve, which the present invention is designed to correct or remedy. The present invention is thus designed with a view toward correcting the cervical posture depicted in FIG. 9 and for maintaining the cervical posture 102 depicted in FIG. 3(*a*), 3(*b*), and 10.

The core exercising device 10 according to the present invention preferably comprises a bar element as at 11; bar sheathing as at 12; opposed end caps as at 13; a pad element as at 14; and a pad sheathing or cover as at 15. The bar element 11 is preferably cylindrical in geometry and constructed from a weighty bar material such as steel and has opposed bar ends, a preferable bar length (as at 100) of 36 inches intermediate the bar ends, and a select bar diameter as chosen or selected from a number of diameters depending on the user's physique and capability. The weighty material of the bar element preferably has a material density on the order of 4.54 ounces/in$^3$.

In other words, given a preferred length of 36 inches for each bar element 11, it is contemplated that a variety of weights may be made available depending on the user's physique and capabilities. Since the material has a uniform or consistent average density, the preferred method for altering or differing the downwardly directed weight 110 across the varied bar elements 11 is to change the diameter or cross-sectional area of each bar element 11. Recall that preferred material density for the bar element 11 is on the order of 4.54 ounces/in$^3$.

It is thus contemplated that a first bar element 11 may comprise a diameter on the order of 1.5 inches and weighs approximately 288 ounces (18 pounds); a second bar element 11 may comprise a diameter on the order of 1.40 inches and weighs approximately 256 ounces (16 pounds); a third bar element may comprise a diameter on to the order of 1.3 inches and weighs approximately 224 ounces (14 pounds); a fourth bar element 11 may comprise a diameter on the order of 1.2 inches and weighs approximately 192 ounces (12 pounds); and a fifth bar element 11 may comprise a diameter on the order of 1.1 inches and weighs approximately 160 ounces (10 pounds).

The foregoing figures are based on the preferred cylindrical geometry for each bar element 11 with a constant length of 36 inches. The formula for the volume of a cylinder is as follows:

$$\pi r^2 h,$$

where "π" is a constant, "r" is the radius of the cylinder, and "h" is the height or length of the cylinder. With a relatively constant material density of 4.54 ounces per cubic inch or 490 pounds per cubic foot, it is contemplated that devices 10 ranging from 10 to 18 pounds in 2 pound increments may well be described by the foregoing descriptions.

The pad element 14 is preferably cylindrical in form and constructed from a high memory foam material relatively lightweight (or negligible in weight) as compared to the bar element 11. The pad element 14 has opposed pad ends and a preferred pad length (as at 101) of about 12 inches or shoulder width, or a third the length of the bar length as at 100. The pad element 14 further comprises a cervical curve-accommodating or receiving outer pad diameter (as at 104) preferably on the order of 3.6 inches (and thereby effecting a radius of curvature on the order of 1.8 inches); a bar-receiving, inner pad diameter as generally and variably referenced at reference numerals 105-109; and a bar-receiving slot as at 16. The inner pad diameter(s) define a bar-receiving tunnel as at 17.

It is thus contemplated that the dimension or diameter referenced at 105 may represent a diameter on the order of 1.5 inches; the dimension or diameter referenced at 106 may represent a diameter on the order of 1.4 inches; the dimension or diameter at 107 may represent a diameter on the order of 1.3 inches; the dimension or diameter at 108 may represent a diameter on the order of 1.2 inches; and the dimension or diameter at 109 may represent a diameter on the order of 1.1 inches.

It will be noted that the select bar diameter (as generally and variably referenced at reference numerals 105-109) is substantially equal in magnitude to the inner pad diameter (as generally and variably referenced at reference numerals 105-109). This structural feature prevents axial displacement of the pad element 14 relative to the bar element 11, there being sufficient friction between the elements 11 and 14 to prevent axial movement of one element relative to the other element.

Figure 4:
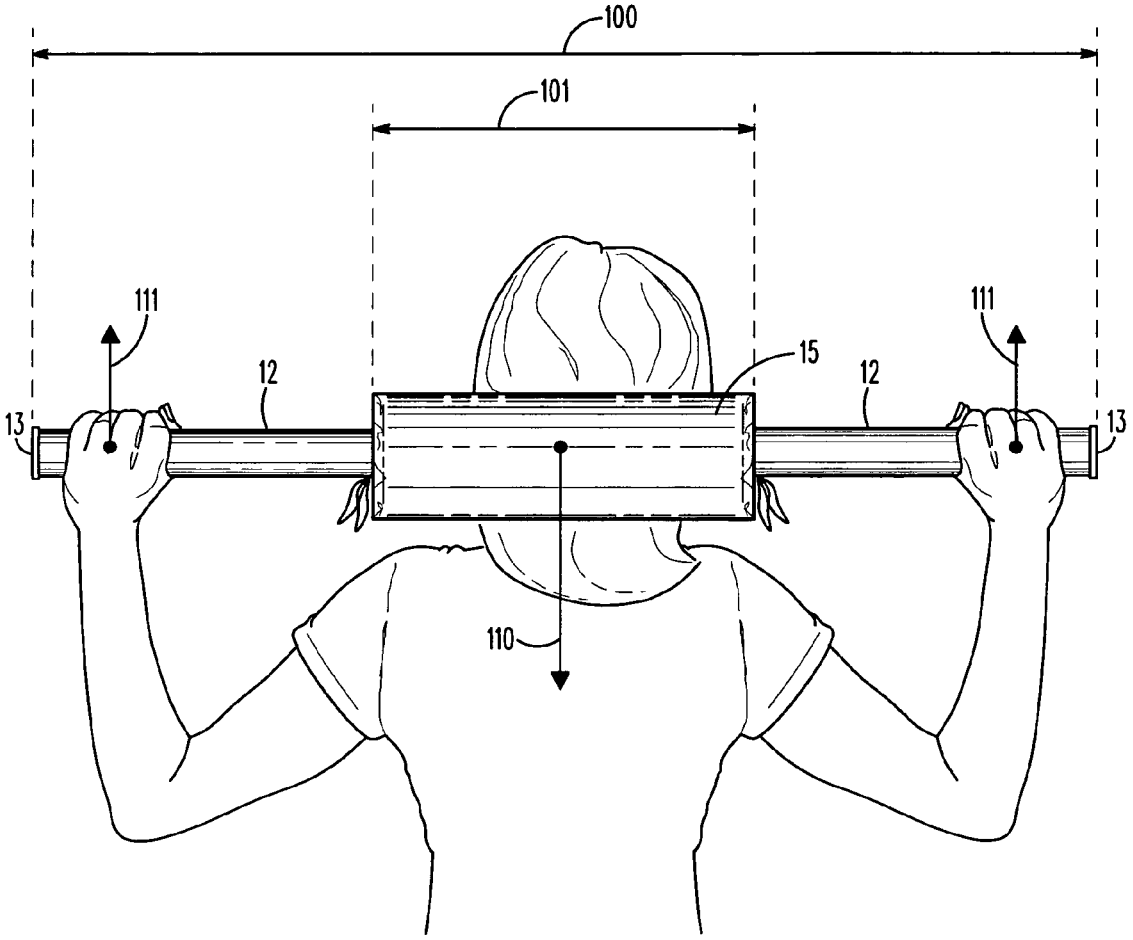
FIG. 4 is a fragmentary back view type depiction of the upper portions of a user holding aloft a weighted core exercising device according to the present invention as received in the user's cervical curve.
Figure 6:
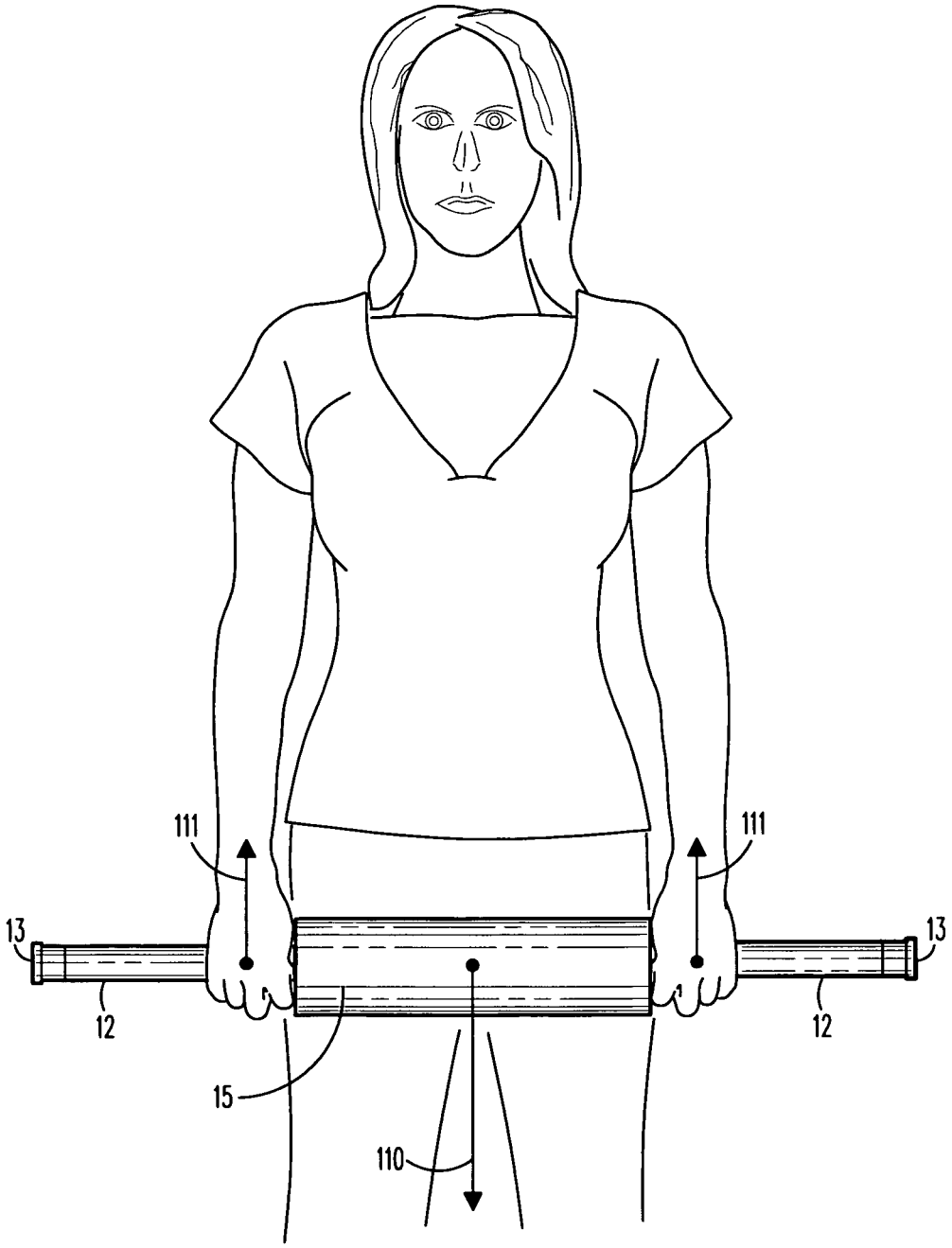
FIG. 6 is a fragmentary front view type depiction of a user holding aloft a weighted core exercising device according to the present invention in the neutral position.
Figure 7:
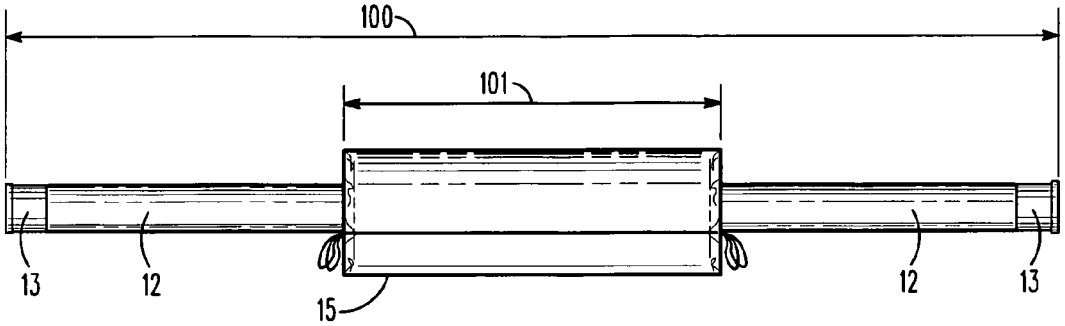
FIG. 7 is a plan view type depiction of the core exercising device according to the present invention showing the relative lengths of a bar element relative to a pad element of the core exercising device.

The bar element 11 is preferably received in the pad element 14 such that the two cylindrical elements are coaxial. Further, the bar element 11 is received in the pad element 14 via the bar-receiving slot 16 such that the pad element 14 is centered along the bar length 100 equidistant from the bar ends as generally depicted in FIGS. 4, 6, and 7. It may be seen from a further inspection of FIGS. 3(*a*) and 3(*b*) that the outer pad diameter 104 is specifically sized so as to accommodate or be finely received in a user's cervical curve for providing tactile information to the user as to how or to what degree the user's cervical curve should be adjusted so as to approximate the radius of curvature of the outer pad diameter 104.

Together the muscular activity associated with resistance training as operating against the downwardly directed weight 110 (which resistance training is generically represented by vectors 111) and the fixed outer pad diameter 104 (resulting in a radius of curvature that substantially matches that of a standard cervical curve) operate to strengthen the core muscles associated with improving and/or maintaining correct posture, particularly correct cervical curve posture.

As earlier specified, the core exercising device 10 according to the present invention may preferably comprise both bar sheathing 12 and pad sheathing 15 so as to provide an interface between the user's body and the underlying material constructions. In other words, the sheathing 12 and/or 15 prevent contact with the underlying material constructions. In this regard, the bar sheathing 12 may be preferably constructed from a cushion-like material and may thus cushion-coat the bar element 11. End caps 13 prevent the bar sheathing 12 from becoming disengaged from the bar element 11.

The pad sheathing 15 further provides a function of sealing the bar-receiving slot 16 for preventing disassembly of the pad element 14 from the bar element 11. Notably, since the pad sheathing 15 comes into regular contact with the user as generally depicted throughout the drawings supporting this specification, it is contemplated that the pad sheathing 15 is preferably removable from the pad element 14 and constructed from a washable material for properly maintaining the core exercising device 10.

In this regard, it is contemplated that the pad sheathing 15 may comprise hook type fastening material as at 18 cooperable with loop type fastening material as at 19. Together the hook and loop fastening material 18/19 (e.g. VELCRO brand hook and loop fastening material) may function to removably fasten the pad sheathing 15 about the pad element 14. Alternatively, the pad sheathing 15 may comprise ties as at 20 for removably binding the pad sheathing 15 about the pad element 14.

While the above description contains much specificity, this specificity should not be construed as limitations on the scope of the invention, but rather as an exemplification of the invention. For example, it is contemplated that the present invention essentially provides a core exercising device (as at 10) for improving posture, which core exercising device essentially comprises a bar element (as at 11) and a pad element (as at 14).

The bar element is preferably constructed from a weighty bar material and has opposed bar ends, a bar length intermediate the bar ends, and a select bar volume. The weighty material has a preferred material density on the order of 4.54 ounces/in$^3$. The pad element, by contrast, is constructed from a lightweight pad material relative to the bar material. The pad element further comprises a pad length, a cervical curve-accommodating, outer pad diameter, and a bar-receiving inner pad tunnel as at 17.

The inner pad tunnel 17 receives the bar element such that the pad element is centered along the bar length equidistant from the bar ends. The outer pad diameter defines a radius of curvature substantially on par or equal in magnitude to the radius of curvature for a standard or normalized cervical curve. The weighty material exercises or trains the user's core muscles. Together, the outer pad diameter and the weighty material function to improve, correct, and/or maintain the user's posture generally, and the user's cervical curve posture, particularly.

The foregoing specifications are further believed to support certain methodology for improving posture, which posture improving method is believed to essentially comprise the steps of providing a weighted bar (e.g. as at 11), which bar has a bar length and a downwardly directed weight (e.g. as at 110). The bar is then outfitted with a pad (e.g. as at 14), which pad comprises an outer pad diameter or radius of curvature substantially equal in magnitude to the radius of curvature of a standard cervical curve.

Figure 5:
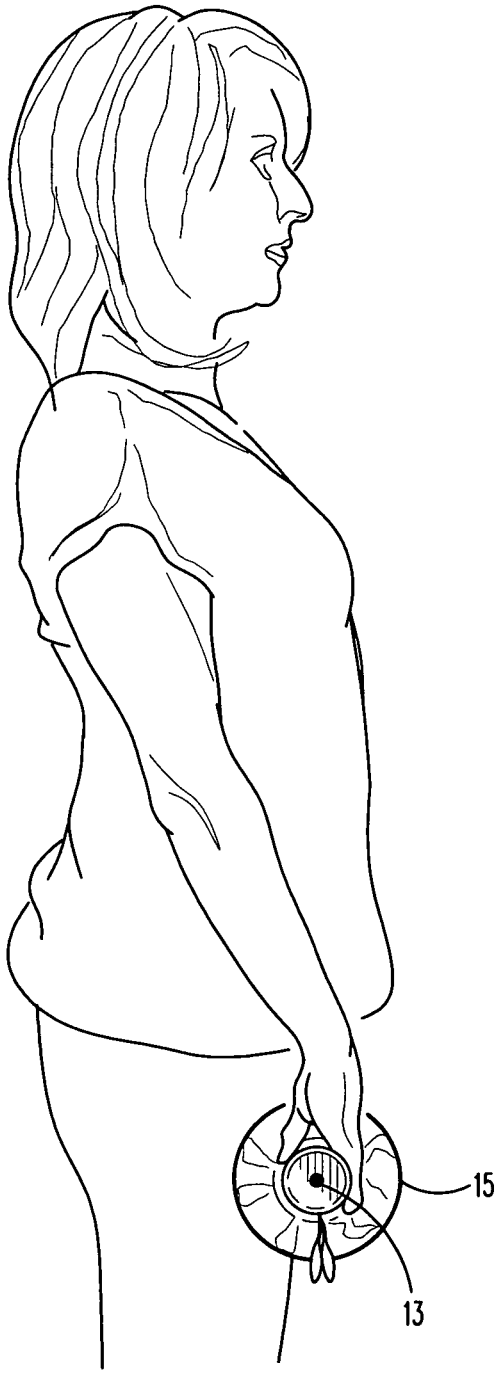
FIG. 5 is a fragmentary side view type depiction of a user holding aloft a weighted core exercising device according to the present invention in the neutral position.
Figure 8:
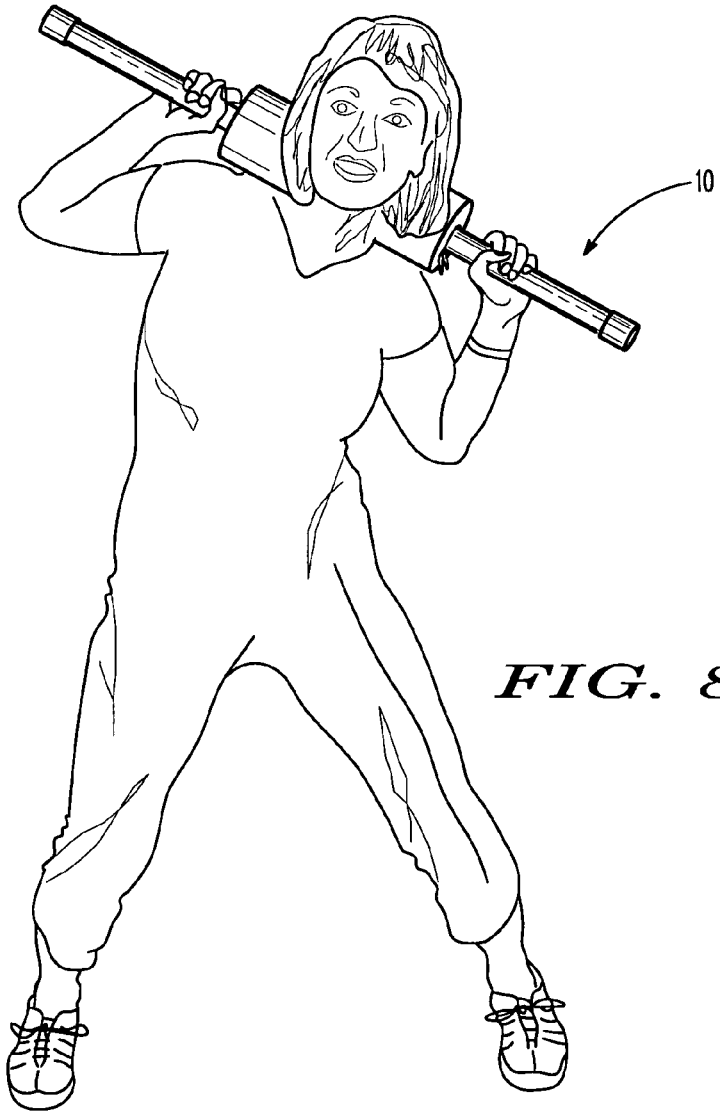
FIG. 8 is a front view depiction of a user holding aloft a weighted core exercising device according to the present invention in a core exercising position.
Figure 10:
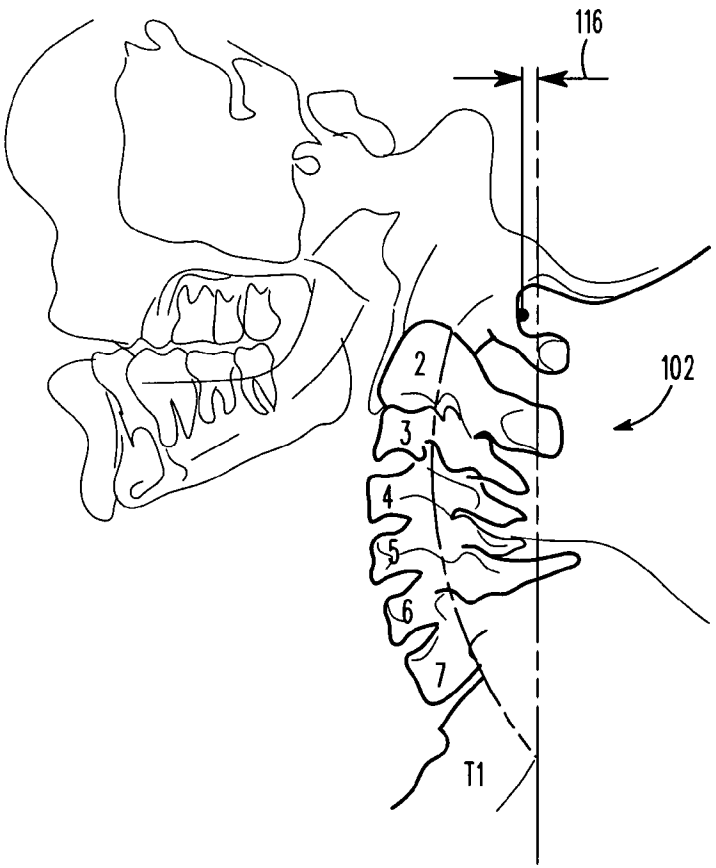
FIG. 10 is a fragmentary side view type depiction of cervical curve anatomy showing normal cervical curve alignment.

The pad is axially centered relative to the bar length and substantially shoulder width comprising opposed pad ends. The method may be said to comprise the additional step of manually holding the bar with a user's hands adjacent the pad ends as generally depicted in FIGS. 6 and 8. It may be further seen from an inspection of FIGS. 5 and 6 that the pad functions to space the user's hands at least shoulder width apart. Notably, FIGS. 5 and 6 depict the neutral position. In this regard, it will be understood from a consideration of the noted figures that the outfitted, weighted bar is anteriorly received adjacent the user's thighs and there maintained via upwardly directed forces as at 111.

FIGS. 3(*a*), 3(*b*), 4 and 8 depict the device 10 (or pad-outfitted bar) posteriorly received adjacent the user's cervical curve and there maintained for further resistance training of the core muscles, which resist the downwardly directed weight of the bar thereby functioning to improve posture via resistance training of the core muscles. It will be recalled that the bar may be constructed from a weighty material having a material density on the order of 4.54 ounces/in$^3$. The bar thus has a select bar volume and the method may be said to comprise the additional step of selecting the select bar volume from the group consisting of 137 inches$^3$, 163 inches$^3$, 191 inches$^3$, 221 inches$^3$, and 254 inches$^3$.

Accordingly, although the invention has been described by reference to certain preferred embodiments, and certain methodology, it is not intended that the novel disclosures herein presented be limited thereby, but that modifications thereof are intended to be included as falling within the broad scope and spirit of the foregoing disclosure, the following claims and the appended drawings.

I claim:

1. A correction device comprising:

a cylindrical elongated bar element on the order of 36 inches in length, and having a diameter selected from the group consisting of 1.1 inches, 1.2 inches, 1.3 inches, 1.4 inches, and 1.5 inches, constructed from a weighty bar material having a density on the order of 4.54 ounces/in$^3$;

a substantially cylindrical pad element on the order of 12 inches which is removably and frictionally mounted on the bar element pad equidistant from the bar element ends, the pad element being constructed from a lightweight foam material having a diameter of approximately 3.6 inches, defining a longitudinal bar-receiving tunnel providing a frictional fit between the tunnel and the bar element, thereby substantially preventing movement of the pad relative to the bar and said pad element defining a longitudinal bar-receiving slot for providing access to said tunnel, and having an outer surface with a radius of curvature of approximately 1.8 inches;

two end caps connect to said bar element;

a bar sheathing surrounding and in contact with the bar element, the bar sheathing adapted to cushion-coat the bar element and prevent a user's direct contact with the bar element; and a pad sheathing completely surrounding an outer surface of the pad element and in contact with the pad element, the pad sheathing removable from the pad element by a fastener, the pad sheathing sealing the bar-receiving slot of the pad element.

2. The correction device of claim 1 wherein the pad element is constructed of memory foam.

* * * * *